US009984800B2

(12) United States Patent
Takajo et al.

(10) Patent No.: US 9,984,800 B2
(45) Date of Patent: May 29, 2018

(54) GRAIN-ORIENTED ELECTRICAL STEEL SHEET AND METHOD OF MANUFACTURING SAME

(71) Applicant: JFE Steel Corporation, Tokyo (JP)

(72) Inventors: Shigehiro Takajo, Tokyo (JP); Ryuichi Suehiro, Tokyo (JP); Hiroi Yamaguchi, Tokyo (JP)

(73) Assignee: JFE Steel Corporation (JP)

( * ) Notice: Subject to any disclaimer, the term of this patent is extended or adjusted under 35 U.S.C. 154(b) by 742 days.

(21) Appl. No.: 14/368,812

(22) PCT Filed: Dec. 28, 2012

(86) PCT No.: PCT/JP2012/084307
§ 371 (c)(1),
(2) Date: Jun. 26, 2014

(87) PCT Pub. No.: WO2013/100200
PCT Pub. Date: Jul. 4, 2013

(65) Prior Publication Data

US 2014/0338792 A1 Nov. 20, 2014

(30) Foreign Application Priority Data

Dec. 28, 2011 (JP) ..... 2011-289783

(51) Int. Cl.
*H01F 1/147* (2006.01)
*C21D 8/12* (2006.01)
(Continued)

(52) U.S. Cl.
CPC ..... *H01F 1/147* (2013.01); *C21D 1/38* (2013.01); *C21D 8/12* (2013.01); *C21D 8/1294* (2013.01);
(Continued)

(58) Field of Classification Search
CPC ..... C21D 8/1294; C21D 8/12; H01F 1/147
(Continued)

(56) References Cited

U.S. PATENT DOCUMENTS 5,296,051 A 3/1994 Inokuti et al.
5,411,604 A * 5/1995 Inokuti ..... H01F 41/0233 148/112
5,665,455 A 9/1997 Sato et al.

FOREIGN PATENT DOCUMENTS

CN 1114687 1/1996
EP 2 799 574 11/2014
(Continued)

OTHER PUBLICATIONS

Chinese Office Action dated Apr. 19, 2016, of corresponding Chinese Application No. 201280064393.1, along with a Concise Statement of Relevance of Office Action in English.
(Continued)

*Primary Examiner* — Weiping Zhu
(74) *Attorney, Agent, or Firm* — DLA Piper LLP (US)

(57) ABSTRACT

A grain-oriented electrical steel sheet allows for manufacture of a transformer that exhibits, when the steel sheet is applied to an iron core thereof, extremely low iron loss and extremely low noise properties, makes highly efficient use of energy, and can be used in various environments. The grain-oriented electrical steel sheet has a strain distribution in regions where closure domains are formed, when observed in a cross section in the rolling direction, with a maximum tensile strain in a sheet thickness direction being 0.45% or less, and with a maximum tensile strain t (%) and a maximum compressive strain c (%) in the rolling direction satisfying Expression (1):

$$t+0.06 \leq t+c \leq 0.35 \quad (1).$$

2 Claims, 7 Drawing Sheets

(51) Int. Cl.

| | |
|---|---|
| ***C22C 38/00*** | (2006.01) |
| ***C22C 38/60*** | (2006.01) |
| ***H01F 1/16*** | (2006.01) |
| ***C22C 38/02*** | (2006.01) |
| ***C22C 38/04*** | (2006.01) |
| ***C21D 1/38*** | (2006.01) |
| *C21D 1/34* | (2006.01) |

(52) U.S. Cl.
CPC ..... *C22C 38/00* (2013.01); *C22C 38/02* (2013.01); *C22C 38/04* (2013.01); *C22C 38/60* (2013.01); *H01F 1/16* (2013.01); *C21D 1/34* (2013.01); *C21D 2201/05* (2013.01)

(58) Field of Classification Search
USPC ..... 148/113
See application file for complete search history.

(56) References Cited

FOREIGN PATENT DOCUMENTS

| | | | |
|---|---|---|---|
| JP | 59-229419 | A | 12/1984 |
| JP | 61-51803 | A | 3/1986 |
| JP | 61-253380 | | 11/1986 |
| JP | 2-8027 | B2 | 2/1990 |
| JP | 3-13293 | B2 | 2/1991 |
| JP | 5-335128 | A | 12/1993 |
| JP | 7-65106 | B2 | 7/1995 |
| JP | 7-320922 | | 12/1995 |
| JP | 3500103 | B2 | 12/2003 |
| JP | 2006-254645 | | 9/2006 |
| JP | 2008-106288 | A | 5/2008 |
| JP | 4123679 | B2 | 7/2008 |
| JP | 4344264 | B2 | 10/2009 |

OTHER PUBLICATIONS

Chinese Office Action dated Aug. 5, 2015 of corresponding Chinese Application No. 201280064393.1 along with an English translation.
Supplementary European Search Report dated May 7, 2015 of corresponding European Application No. 12864000.0.
Office Action dated Jun. 2, 2015 of corresponding Japanese Application No. 2011-289783 along with its English translation.
Notice of Reasons for Rejection dated Apr. 30, 2015 of corresponding Korean Application No. 10-2014-7017560.

* cited by examiner

GRAIN-ORIENTED ELECTRICAL STEEL SHEET AND METHOD OF MANUFACTURING SAME

TECHNICAL FIELD

This disclosure relates to a grain-oriented electrical steel sheet for use as an iron core of a transformer or the like, and to a method of manufacturing the same, in an effort to, in particular, reduce iron loss and noise at the same time.

BACKGROUND

In recent years, in the context of efficient use of energy, there have been demands mainly from transformer manufacturers and the like for an electrical steel sheet with high flux density and low iron loss.

Flux density can be improved by making crystal orientations of the electrical steel sheet in accord with the Goss orientation. JP 4123679 B2, for example, discloses a method of producing a grain-oriented electrical steel sheet having a flux density $B_8$ exceeding 1.97 T.

On the other hand, iron loss properties may be improved by increased purity of the material, high orientation, reduced sheet thickness, addition of Si and Al, and magnetic domain refining (for example, see "Recent progress in soft magnetic steels," 155th/156th Nishiyama Memorial Technical Seminar, The Iron and Steel Institute of Japan, Feb. 10, 1995). Iron loss properties, however, tend to worsen as the flux density $B_8$ is higher, in general.

It is known, for example, that when the crystal orientations are accorded with the Goss orientation to improve the flux density $B_8$, magnetostatic energy decreases and, therefore, the magnetic domain width widens, causing eddy current loss to rise.

In view of this, as a method of reducing eddy current loss, some techniques have been used to refine magnetic domains by improving film tension (for example, see JP H02-8027 B2) and applying thermal strain.

With the method of improving film tension disclosed in JP '027, however, the strain applied near a elastic region is small, which places a limit on the iron loss reduction effect.

On the other hand, magnetic domain refining by application of thermal strain is performed using plasma flame irradiation, laser irradiation, electron beam irradiation and the like.

For example, JP H07-65106 B2 discloses a method of producing an electrical steel sheet having a reduced iron loss $W_{17/50}$ of below 0.8 W/kg due to electron beam irradiation. It can be seen from JP '106 that electron beam irradiation is extremely useful for reducing iron loss.

In addition, JP H03-13293 B2 discloses a method of reducing iron loss by applying laser irradiation to a steel sheet.

Meanwhile, it is known that irradiating with a plasma flame, laser, an electron beam and the like increases hysteresis loss, while causing magnetic domain refinement which reduces eddy current loss.

For example, JP 4344264 B2 states that any hardening region caused in a steel sheet through laser irradiation and the like hinders domain wall displacement to increase hysteresis loss. To minimize iron loss, it is thus necessary to reduce eddy current loss while suppressing an increase in hysteresis loss.

To solve the aforementioned problem, some techniques have been proposed to optimize hysteresis loss and eddy current loss in terms of different aspects, and thereby reduce iron loss.

For example, JP '264 discloses a technique to further reduce iron loss by adjusting the laser output and spot diameter ratio to thereby reduce the size of a region, which hardens with laser irradiation, in a direction perpendicular to the laser scanning direction, to 0.6 mm or less, and by suppressing an increase in hysteresis loss due to the irradiation.

In addition, JP 2008-106288 A discloses a technique of reducing iron loss by optimizing the integral value of the compressive residual stress in a rolling direction of a steel sheet in a cross section perpendicular to the sheet width direction to enhance the effect of reducing the eddy current loss.

Furthermore, there has been an increasing demand for reduced transformer noise, as well as high flux density and low iron loss to offer good living conditions. It is believed that the noise of a transformer is primarily caused by stretching movement of the crystal lattice of the iron core, and many studies have shown that reducing single sheet magnetic strain is effective in suppressing the transformer noise (for example, see JP 3500103 B2).

With the conventional methods of reducing iron loss proposed by JP '264 and JP '288, it is possible to reduce either hysteresis loss or eddy current loss, respectively, yet reducing noise at the same time is challenging.

For example, the residual stress distribution illustrated in JP '288 consists of a large, rolling-direction tensile stress near a laser irradiation portion on the steel sheet surface and a relatively large, rolling-direction compressive residual stress produced below in the sheet thickness direction. In this way, when a rolling-direction tensile stress and a rolling-direction compressive stress are concurrently present, the steel sheet tends to deform to release the stresses. Consequently, for transformers fabricated from a combination of such grain-oriented electrical steel sheets, iron cores take such a deformation mode as to release the internal stress upon excitation, in addition to the deformation due to stretching movement of the crystal lattice, resulting in an increase in noise.

SUMMARY

We provide:

[1] A grain-oriented electrical steel sheet comprising closure domains linearly formed to extend in a direction that intersects a rolling direction of the grain-oriented electrical steel sheet, the closure domains being arranged at periodic intervals in the rolling direction, the grain-oriented electrical steel sheet having a strain distribution in regions where the closure domains are formed, when observed in a cross section in the rolling direction, with a maximum tensile strain in a sheet thickness direction being 0.45% or less, and with a maximum tensile strain t (%) and a maximum compressive strain c (%) in the rolling direction satisfying Expression (1):

$$t+0.06 \leq t+c \leq 0.35 \quad (1).$$

[2] A method of manufacturing the grain-oriented electrical steel sheet of the aspect [1], the method comprising irradiating a steel sheet with a high energy beam in a direction that intersects a rolling direction of the steel sheet, wherein the steel sheet is irradiated with the high energy beam in a direction forming an angle of 30° or less with a direction orthogonal to the rolling direction, at periodic intervals of 10 mm or less in the rolling direction, and under a condition that a surface scanning rate v (m/s) on the steel sheet and a beam diameter d (μm) satisfy Expression (2):

$$200 \leq d \leq -0.04 \times v^2 + 6.4 \times v + 190 \quad (2).$$

Our grain-oriented electrical steel sheets exhibit extremely low iron loss and extremely low noise properties and, consequently, may be used to produce a transformer that can make highly efficient use of energy and can be used in various environments when applied to an iron core of a transformer and the like.

Additionally, our steel sheets may have a transformer iron loss $W_{17/50}$ of as low as 0.90 W/kg or less and a noise level of lower than 45 dBA (with a background noise level of 30 dBA).

BRIEF DESCRIPTION OF THE DRAWINGS

Our steel sheets and methods will be further described below with reference to the accompanying drawings.

FIG. 8 is a view showing a tensile strain distribution on a steel sheet surface that was irradiated with a laser beam, an electron beam or the like.

DETAILED DESCRIPTION

We found that low iron loss and low noise may be achieved at the same time by controlling the distribution of tensile and compressive strains produced in a steel sheet upon application of a high energy beam for magnetic domain refining.

A larger compressive strain in the rolling direction is more preferred, since it stabilizes closure domains and enhances the magnetic domain refining effect. In contrast, however, a smaller tensile strain in the rolling direction is more preferred since it not only destabilizes closure domains, but also makes, if the tensile strain is excessively large relative to the compressive strain, the steel sheet more susceptible to deformation such as deflection, with the result being a significant increase in transformer noise.

Figure 8:
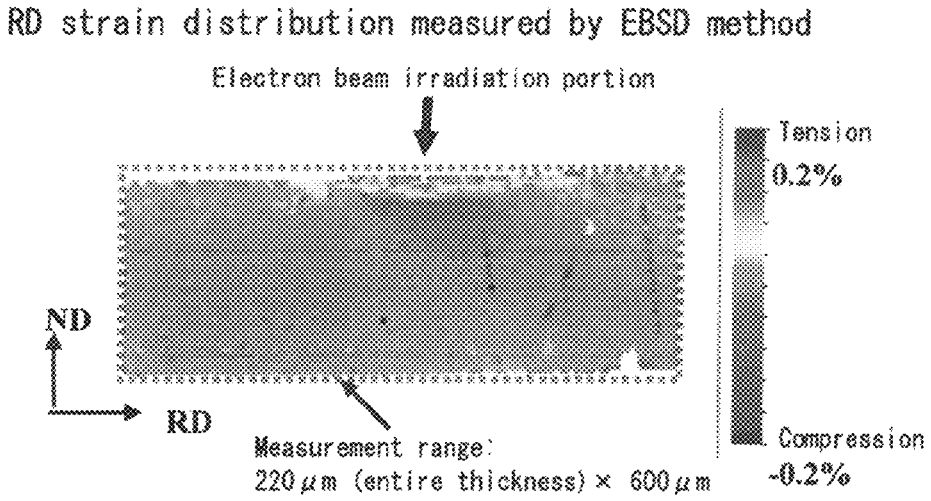

It has conventionally been known that compressive strain (or compressive stress) in the rolling direction coexists with high tensile strain (or tensile stress) in the rolling direction or a direction orthogonal to the rolling direction. For example, referring to the rolling-direction stress distribution shown in FIG. 2 of JP '288, there is a very large tensile stress of 40 kgf/mm$^2$, which is nearly twice as large as the compressive stress of 22 kgf/mm$^2$. That tensile stress was presumably caused by a temperature rise in a surface layer part of a steel sheet that had been irradiated with a laser beam or the like, and the resulting thermal expansion in the rolling direction, which was maintained even after the cooling of the steel sheet. As shown in FIG. 8, our experiments and analysis have also proved that tensile strain is present on steel sheet surfaces irradiated with a laser beam, an electron beam or the like. Such controlling of the tensile stress distribution and the tensile strain distribution is a new perspective, the perspective not being suggested by JP '28 which merely aims to reduce only iron loss, and thus is important in reducing noise.

We discovered that the conditions for laser irradiation, electron beam irradiation or the like may be adjusted in terms of the aforementioned expansion direction to make it possible to restrict expansion in the rolling direction while facilitating expansion in the sheet thickness direction and, furthermore, to make the tensile strain small relative to the compressive strain in the rolling direction, to thereby obtain a stain distribution advantageous for reducing both iron loss and noise.

We also discovered that it is possible to increase the tensile strain in the sheet thickness direction by adjusting, as one of conditions affecting the aforementioned expansion direction, the beam diameter to fall within an appropriate range, depending on the scanning rate of a high energy beam such as a heat beam, a light beam, a particle beam or the like.

Grain-Oriented Electrical Steel Sheet

We provide grain-oriented electrical steel sheets which may or may not be provided with a coating such as an insulating coating on the steel substrate. In measuring transformer iron loss and noise, however, the stacked steel sheets should be insulated from one another.

Further, the grain-oriented electrical steel sheets are manufactured by the following method, for example, to have closure domains linearly formed to extend in a direction orthogonal to the rolling direction and arranged at constant intervals in the rolling direction.

In addition, the grain-oriented electrical steel sheet has a strain distribution in regions where the closure domains are formed, when observed in a cross section in the rolling direction, with a maximum tensile strain in a sheet thickness direction being 0.45% or less, and with a maximum tensile strain t (%) and a maximum compressive strain c (%) in the rolling direction satisfying Expression (1):

$$t + 0.06 \leq t + c \leq 0.35 \quad (1).$$

Note that the strain distribution in a cross section in the rolling direction may be measured by, for example, X-ray analysis, the EBSD-Wilkinson method or the like.

Figure 1:
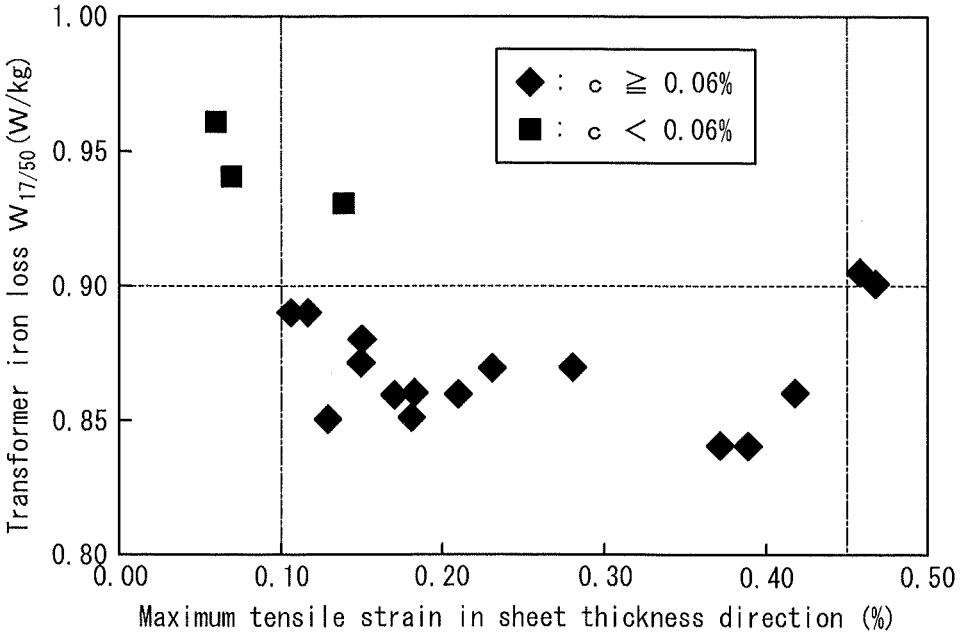
FIG. 1 is a graph showing a relationship between the maximum tensile strain in the sheet thickness direction and the transformer iron loss $W_{17/50}$, plotting parameters of the maximum compressive strain c in the rolling direction.

Additionally, we fabricated steel sheets having different strain distributions under a variety of beam irradiation conditions to investigate the relationship among the strain, iron loss and noise of the steel sheets. We found the following:

(I) As FIG. 1 shows, transformer iron loss $W_{17/50}$ is 0.90 W/kg or less where the maximum tensile strain in the sheet thickness direction is 0.45% or less and the maximum compressive strain c in the rolling direction is 0.06% or more. A maximum compressive strain c in the rolling direction of smaller than 0.06% results in an excessively small magnetic domain refining effect and is less effective in reducing the iron loss (eddy current loss). On the other hand, a maximum tensile strain in the sheet thickness direction exceeding 0.45% causes excessive strain which results in increased hysteresis loss due to application of dislocations or the like and, consequently, insufficient reduction of iron loss.

As can be seen from the above, the iron loss properties may be controlled by, from the viewpoint of reducing the eddy current loss, increasing the maximum compressive strain c in the rolling direction, and from the viewpoint of suppressing an increase in hysteresis loss, reducing the maximum tensile strain in the sheet thickness direction.

Figure 2:
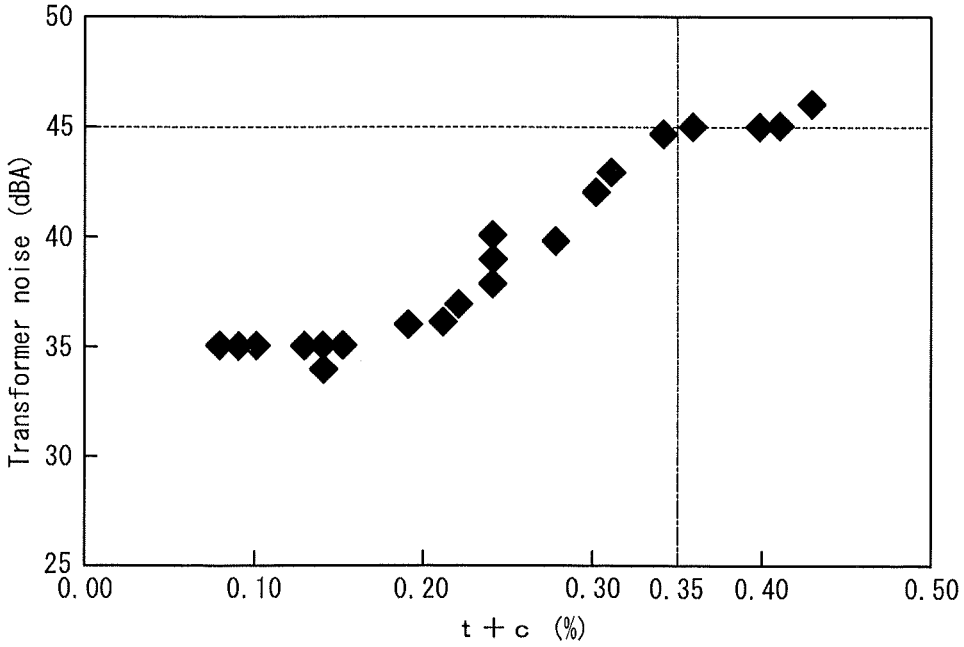
FIG. 2 is a graph showing the relationship between the transformer noise and the total (t+c) of the maximum tensile strain t in the rolling direction and the maximum compressive strain c.
Figure 3:
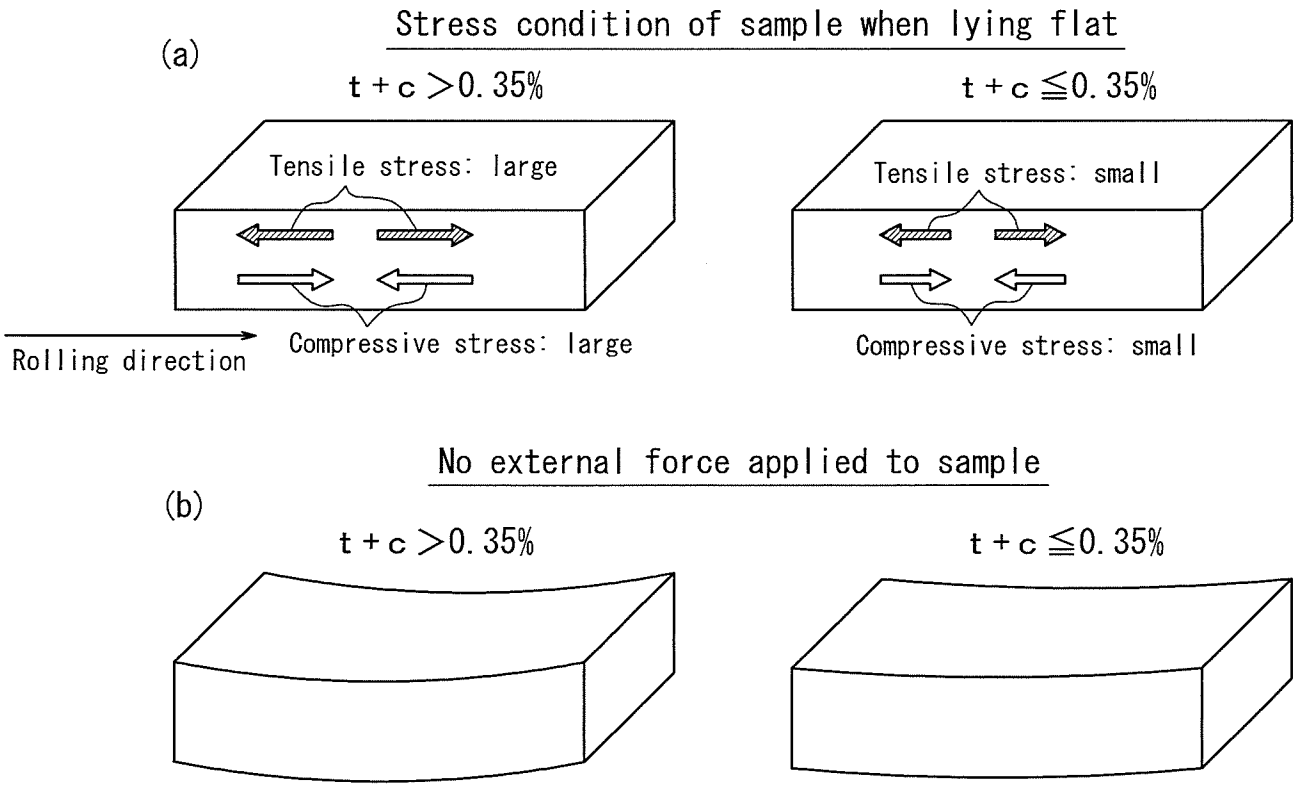
FIG. 3 is a diagram for illustrating how the stress conditions in a steel sheet based on the tensile strain and compressive strain in the rolling direction affect the deflection of the steel sheet.

(II) As FIG. 2 shows, the transformer noise is less than 45 dB where a total of the maximum tensile strain t in the rolling direction and the maximum compressive strain c is $t+c \leq 0.35\%$. On the other hand, where $t+c > 0.35\%$, a strong tensile stress, a strong compressive stress, or both are present in the rolling direction. In this case, as shown in FIG. 3, we believe that the steel sheet is more prone to deformation to release the stresses and, consequently, when finished into an iron core of a transformer, in addition to deformation due to stretching movement of the crystal lattice, the iron core takes such a deformation mode as to release the internal stress upon excitation, resulting in an increase in noise.

As mentioned above, since the condition for a maximum compressive strain c in the rolling direction to offer low iron loss properties is:

$$0.06 \leq c, \text{ thus } t+0.06 \leq t+c,$$

it is necessary to satisfy Expression (1) to achieve low iron loss and low noise at the same time:

$$t+0.06 \leq t+c \leq 0.35 \quad (1).$$

While the irradiation conditions for irradiating with a high-energy beam, i.e., a heat beam, a light beam, a particle beam or the like, will be described in the context of using an electron beam, the basic concepts are also applicable to other irradiation conditions such as laser irradiation and plasma flame irradiation.

Conditions of Electron Beam Irradiation

The grain-oriented electrical steel sheet may be manufactured by irradiation with an electron beam to extend in a direction that intersects a rolling direction of the steel sheet, preferably in a direction forming an angle of 30° or less with a direction orthogonal to the rolling direction. The aforementioned scanning from one end to the other of the steel sheet is repeated with a constant interval of 2 mm to 10 mm in the rolling direction between repetitions of the irradiation. If this interval is excessively short, productivity is excessively lowered and, therefore, the interval is preferably 2 mm or more. Alternatively, if the interval is excessively long, the magnetic domain refining effect is not sufficiently achieved and, therefore, the interval is preferably 10 mm or less.

In addition, multiple irradiation sources may be used for beam irradiation if the material to be irradiated is too large in width.

Figure 4:
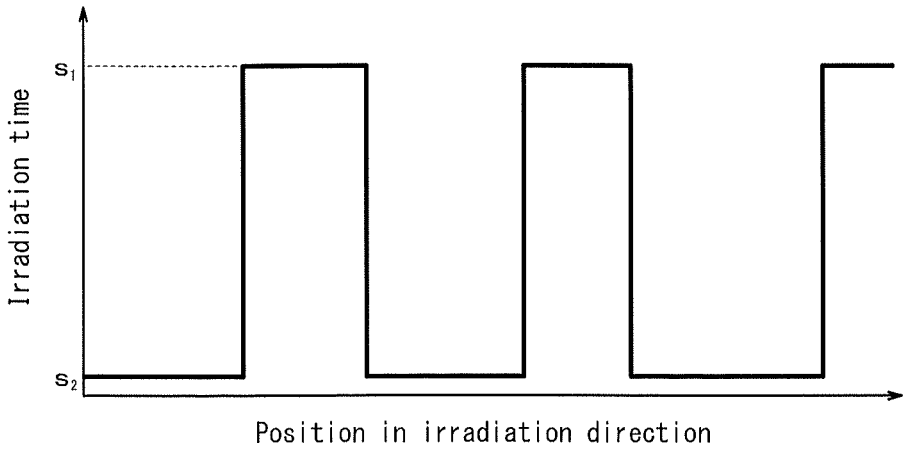
FIG. 4 is a graph showing a mode of electron beam irradiation.

For electron beam irradiation, for example, the irradiation was repeated along the scanning line so that a long irradiation time ($s_1$) and a short irradiation time ($s_2$) alternate, as shown in FIG. 4. Distance intervals (hereinafter, "dot pitch") between the repetitions of the irradiation are each preferably 0.6 mm or less. Since $s_2$ is generally small enough to be ignored as compared with $s_1$, the inverse of $s_1$ can be considered as the irradiation frequency. A dot pitch wider than 0.6 mm results in a reduction in the area irradiated with sufficient energy. The magnetic domains are therefore not sufficiently refined.

In addition, the beam scanning over an irradiation portion on the steel sheet is preferably performed at a scanning rate of 100 m/s or lower. A higher scanning rate requires higher energy per unit time to irradiate energy required for magnetic domain refinement. In particular, upon the scanning rate exceeding 100 m/s, the irradiation energy per unit time becomes excessively high, which may potentially impair the stability, lifetime and the like of the device. On the other hand, if the scanning rate is excessively low, productivity is excessively lowered and, therefore, the scanning rate is desirably not lower than 10 m/s.

Further, as a beam profile, the beam diameter d (μm) of the electron beam needs to satisfy Expression (2):

$$200 \leq d \leq -0.04 \times v^2 + 6.4 \times v + 190 \quad (2)$$

where v (m/s) denotes a scanning rate at which the electron beam is scanned over a surface of the steel sheet.

Figure 5:
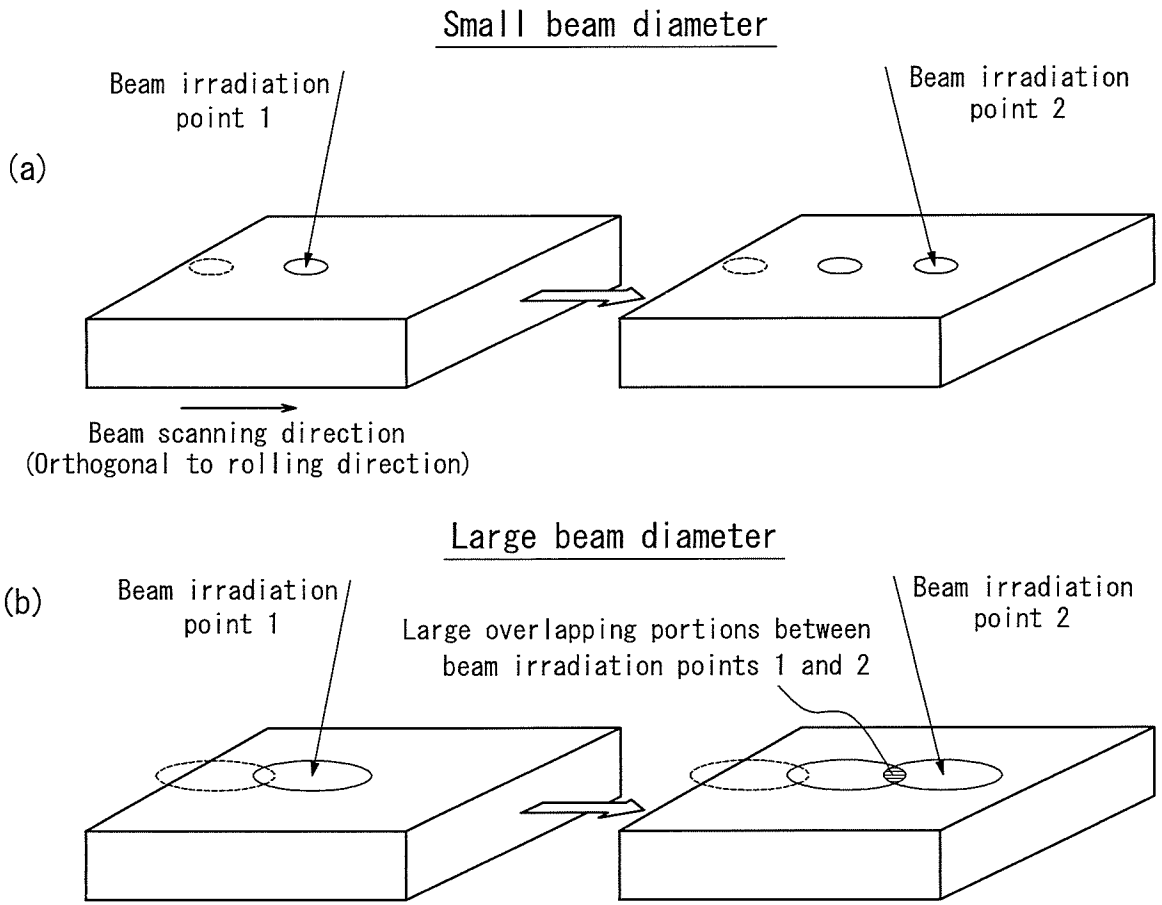
FIG. 5 is a diagram schematically illustrating the difference between the conditions under which strains are applied to a steel sheet for different beam diameters.

If the beam diameter is smaller than 200 μm, the beam has an excessively high energy density and the strain increases, resulting in increased hysteresis loss and noise. On the other hand, if the beam diameter is excessively large, a problem arises in the case of spot-like irradiation, as schematically illustrated in FIG. 5, such that the overlapping portions of beam spots-irradiated with a beam for a long period of time become larger in size or, in the case of continuous beam irradiation, such that the beam irradiation time (beam diameter in the rolling direction/beam scanning rate) at a point on the beam scanning line becomes excessively long. Therefore, the beam diameter is $(-0.04 \times v^2 + 6.4 \times v + 190)$ μm or less.

Although the details of the mechanism are unclear, a long time irradiation provides a larger tensile residual strain in the rolling direction after the beam irradiation and worsens noise properties, possibly because expansion of the steel sheet propagates as far as a region in the in-plane direction due to thermal diffusion. Therefore, a higher scanning rate is preferred for a larger beam diameter.

Figure 6:
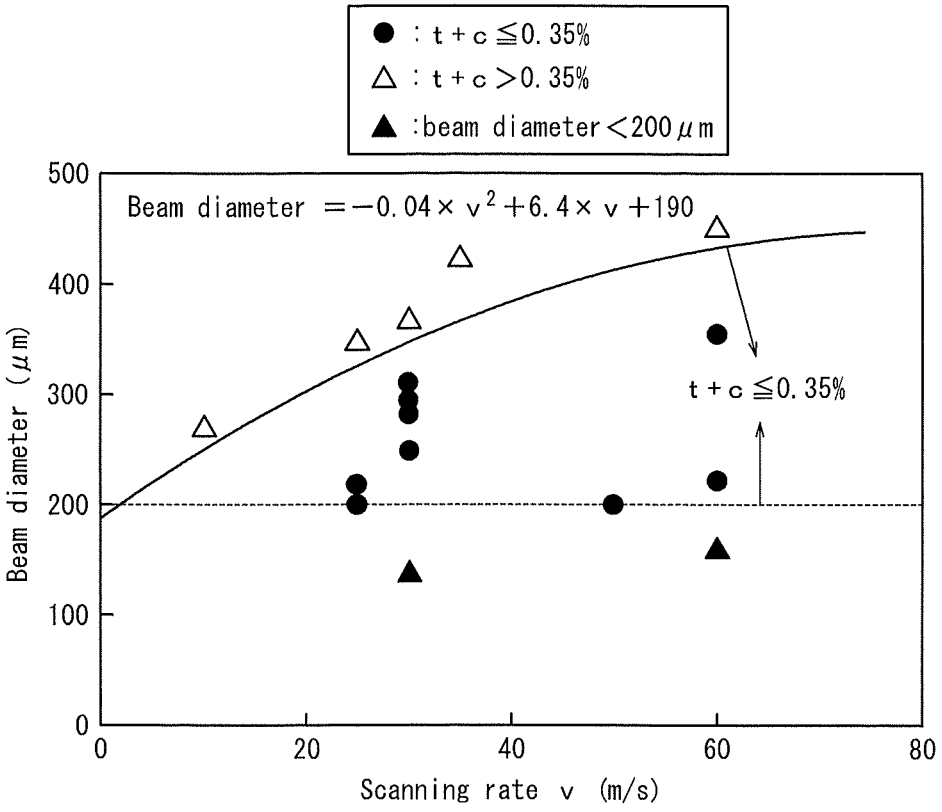
FIG. 6 is a graph showing how the surface scanning rate v and the beam diameter d affect the total (t+c).

We studied the relationship between the beam diameter and the result of (t+c), and found that the result of (t+c) after irradiation can be small when the beam diameter is $(-0.04 \times v^2 + 6.4 \times v + 190)$ μm or less, as shown in FIG. 6.

Consequently, the surface scanning rate v (m/s) and the beam diameter d (μm) satisfy Expression (2):

$$200 \leq d \leq -0.04 \times v^2 + 6.4 \times v + 190 \quad (2).$$

In this case, the electron beam profile was determined by a well-known slit method. The slit width was adjusted to be 30 μm and the half width of the obtained beam profile was used as the beam diameter.

In addition to this, other conditions such as irradiation energy are adjusted within different ranges and have different proper values depending on WD (working distance), the degree of vacuum and the like and, therefore, were adjusted as appropriate based on conventional knowledge. In the case of a laser, the half width of the beam profile determined by a knife-edge method was used as the beam diameter.

Evaluation of Iron Loss and Noise

Figure 7:
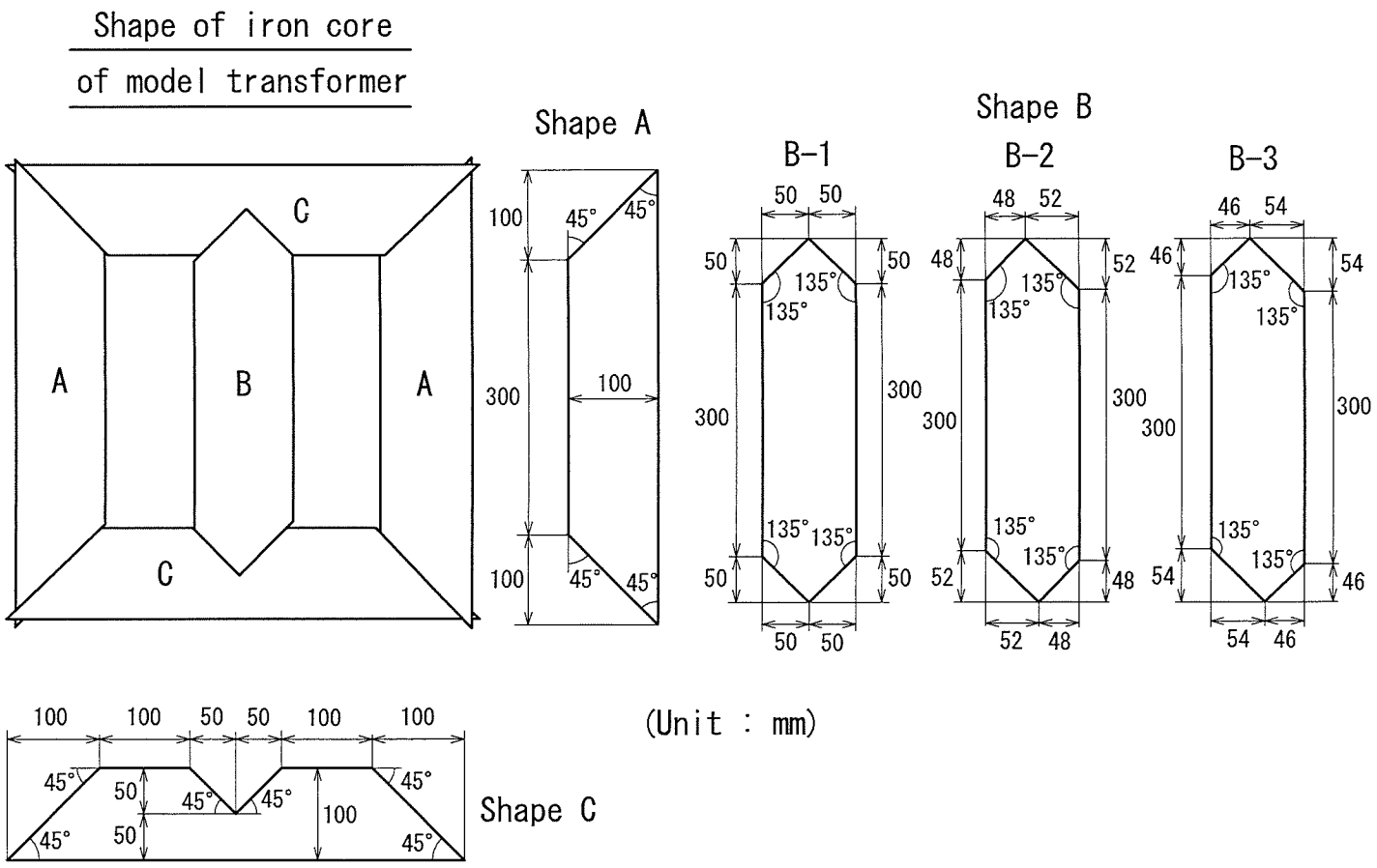
FIG. 7 is a view for illustrating the shape of an iron core of a model transformer.

Iron loss and noise were evaluated using model transformers, each simulating a transformer with an iron core of stacked three-phase tripod type. As shown in FIG. 7, each model transformer was formed by steel sheets with outer dimensions of 500 mm square and a width of 100 mm. Steel sheets each having been sheared to be in shapes with beveled edges as shown in FIG. 7 were stacked to obtain a stack thickness of about 15 mm and an iron core weight of about 20 kg: i.e., 70 sheets of 0.23 mm thick steel sheets; 60 sheets of 0.27 mm thick steel sheets; or 80 sheets of 0.20 mm thick steel sheets. The measurements were performed so that the rolling direction matches the longitudinal direction of each sample sheared to have beveled edges. The lamination method was as follows: sets of two sheets were laminated in five steps using a step-lap joint scheme. Specifically, three types of central leg members (shape B), one symmetric member (B-1) and two different asymmetric members (B-2, B-3) (and additional two asymmetric members obtained by reversing the other two asymmetric members (B-2, B-3), and in fact, five types of central leg members) are used and, in practice, stacked in order of, for example, "B-3," "B-2," "B-1," "reversed B-2," and "reversed B-3."

The iron core components were stacked flat on a plane and then sandwiched and clamped between bakelite retainer plates under a pressure of about 0.1 MPa. The transformers were excited with the three phases being 120 degrees out of phase with one another, in which iron loss and noise were measured with a flux density of 1.7 T. A microphone was used to measure noise at (two) positions distant by 20 cm from the iron core surface, in which noise levels were represented in units of dBA with A-scale frequency weighting.

Chemical Composition of Material

The grain-oriented electrical steel sheet is applied is such a material that has a chemical composition containing the elements shown below.

Si: 2.0 mass % to 8.0 mass %

Silicon (Si) is an element effective in terms of enhancing electrical resistance of steel and improving iron loss properties thereof. However, a Si content in steel below 2.0 mass % cannot provide a sufficient iron loss reducing effect. On the other hand, a Si content in steel above 8.0 mass % significantly reduces the formability of steel and reduces the flux density thereof. Therefore, the content of Si is preferably 2.0 mass % to 8.0 mass %.

C: 50 mass ppm or less

Carbon (C) is added for the purpose of improving the texture of a hot rolled steel sheet. However, to prevent magnetic aging from occurring in the resulting product steel sheet, the content of C is preferably reduced to 50 mass ppm or less.

Mn: 0.005 mass % to 1.0 mass %

Manganese (Mn) is an element necessary to achieve better hot workability of steel. When the content of Mn in steel is below 0.005 mass %, however, this effect is insufficient. On the other hand, when the content of Mn is above 1.0 mass %, the magnetic flux of the resulting product steel sheet worsens. Therefore, the content of Mn is preferably 0.005 mass % to 1.0 mass %.

Furthermore, in addition to the above basic components, the following elements may also be included as deemed appropriate to improve to improve magnetic properties:

at least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

Nickel (Ni) is an element useful in improving the texture of a hot rolled steel sheet for better magnetic properties thereof. However, a Ni content in steel below 0.03 mass % is less effective in improving magnetic properties, while a Ni content in steel above 1.50 mass % destabilizes secondary recrystallization, resulting in deteriorated magnetic properties. Therefore, the content of Ni is preferably 0.03 mass % to 1.50 mass %.

In addition, tin (Sn), antimony (Sb), copper (Cu), phosphorus (P), molybdenum (Mo), and chromium (Cr) are useful elements in terms of improving magnetic properties of steel. However, each of these elements becomes less effective in improving magnetic properties of steel when contained in the steel in an amount less than the aforementioned lower limit and inhibits the growth of secondary recrystallized grains of the steel when contained in the steel in an amount exceeding the aforementioned upper limit. Thus, each of these elements is preferably contained within the respective ranges thereof specified above.

The balance other than the above-described elements is Fe and incidental impurities that are incorporated during the manufacturing process.

EXAMPLES

Example 1

In this example, used as samples irradiated with an electron beam or a laser beam were grain-oriented electrical steel sheets with coating, each of which had Bg in the rolling direction measured in SST (single sheet tester) in the range of 1.91 T to 1.95 T and exhibited iron loss $W_{17/50}$ measured in the respective model transformers in the range of 1.01 W/kg to 1.03 W/kg. Each of the steel sheets with coating has a structure such that a dual-layer coating is formed on the steel substrate surfaces, including a vitreous coating, which is mainly composed of $Mg_2SiO_4$, and a coating (phosphate-based coating), which is formed by baking an inorganic treatment solution thereon.

In each electron beam or laser irradiation run, an electron beam or a laser beam was scanned in a direction orthogonal to the rolling direction of the steel sheet, linearly over the entire width of the steel sheet to traverse the steel sheet, and at constant intervals of 5 mm in the rolling direction. In this case, the laser irradiation was performed using a fiber laser device of continuous oscillation type with a near-infrared laser wavelength of about 1 μm. In addition, the beam diameter was the same in the rolling direction and in the direction orthogonal to the rolling direction. Further, in the electron beam irradiation, the acceleration voltage was 60 kV, the dot pitch was 0.01 mm to 0.40 mm, the shortest distance from the center of a converging coil to the irradiated material was 700 mm, and the pressure in the working chamber was 0.5 Pa or less.

The strain distribution in a cross section in the rolling direction was measured by the EBSD-Wilkinson method using CrossCourt Ver. 3.0 (produced by BLG Productions, Bristol). The measurement field of view covered the range of "a length of 600 μm or more in the rolling direction×the total thickness," and adjusted that the center of the laser irradiation or electron beam irradiation point substantially coincides with the center of the measurement field of view. In addition, the measurement pitch was 5 μm and a strain-free reference point was selected at a point distant by 50 μm from the edge of the measurement field of view in the same grain.

The obtained results are shown in Table 1.

TABLE 1

| No. | Thermal Strain Applied by | Beam Diameter d (μm) | Irradiation Energy (W) | Scanning Rate v (m/s) | Maximum Beam Diameter in Expression (2) (μm) | Maximum Tensile Strain in Sheet Thickness Direction (%) | Maximum Tensile Strain in Rolling Direction t (%) | Maximum Compressive Strain in Rolling Direction c (%) | t + c (%) | Transformer Iron Loss $W_{17/50}$ (W/kg) | Noise (dBA) | Remarks |
|---|---|---|---|---|---|---|---|---|---|---|---|---|
| 1 | Electron Beam | 260 | 510 | 30 | 346 | 0.11 | 0.08 | 0.06 | 0.14 | 0.89 | 35 | Example |
| 2 | Electron Beam | 250 | 660 | 30 | 346 | 0.18 | 0.15 | 0.13 | 0.28 | 0.86 | 40 | Example |
| 3 | Electron Beam | 260 | 420 | 15 | 277 | 0.18 | 0.14 | 0.10 | 0.24 | 0.85 | 40 | Example |
| 4 | Electron Beam | 275 | 1380 | 60 | 430 | 0.23 | 0.12 | 0.12 | 0.24 | 0.87 | 39 | Example |
| 5 | Electron Beam | 260 | 720 | 30 | 346 | 0.42 | 0.14 | 0.16 | 0.30 | 0.86 | 42 | Example |
| 6 | Electron Beam | 260 | 960 | 30 | 346 | 0.39 | 0.22 | 0.18 | 0.40 | 0.84 | 45 | Comparative Example |
| 7 | Electron Beam | 275 | 1020 | 30 | 346 | 0.46 | 0.25 | 0.16 | 0.41 | 0.91 | 45 | Comparative Example |
| 8 | Electron Beam | 275 | 1080 | 30 | 346 | 0.47 | 0.26 | 0.17 | 0.43 | 0.90 | 46 | Comparative Example |
| 9 | Electron Beam | 260 | 420 | 30 | 346 | 0.06 | 0.05 | 0.04 | 0.09 | 0.96 | 35 | Comparative Example |
| 10 | Electron Beam | 260 | 840 | 30 | 346 | 0.13 | 0.19 | 0.12 | 0.31 | 0.85 | 43 | Example |
| 11 | Electron Beam | 320 | 720 | 30 | 346 | 0.17 | 0.15 | 0.10 | 0.25 | 0.88 | 40 | Example |
| 12 | Electron Beam | 290 | 960 | 30 | 346 | 0.21 | 0.22 | 0.14 | 0.36 | 0.86 | 45 | Comparative Example |
| 13 | Electron Beam | 280 | 540 | 30 | 346 | 0.12 | 0.12 | 0.07 | 0.19 | 0.89 | 36 | Example |
| 14 | Electron Beam | 285 | 600 | 30 | 346 | 0.15 | 0.15 | 0.09 | 0.24 | 0.87 | 38 | Example |
| 15 | Laser | 330 | 400 | 30 | 346 | 0.23 | 0.17 | 0.15 | 0.32 | 0.85 | 43 | Example |
| 16 | Laser | 380 | 650 | 40 | 382 | 0.20 | 0.17 | 0.14 | 0.31 | 0.87 | 41 | Example |

Expression (2): $-0.04 \times v^2 + 6.4 \times v + 190$

It can be seen from Table 1 that a grain-oriented electrical steel sheet that satisfies the conditions of low iron loss of 0.90 W/kg or less and low noise of less than 45 dBA may be obtained, provided that it has a maximum tensile strain in the sheet thickness direction of 0.45% or less and a total (t+c) of the maximum tensile strain t and the maximum compressive strain c in the rolling direction of 0.35 or less.

The invention claimed is:

1. A grain-oriented electrical steel sheet comprising closure domains linearly formed to extend in a direction that intersects a rolling direction of the grain-oriented electrical steel sheet, the closure domains arranged at periodic intervals in the rolling direction, the grain-oriented electrical steel sheet having a strain distribution in regions where the closure domains are formed when observed in a cross section in the rolling direction, with a maximum tensile strain in a sheet thickness direction of 0.45% or less, a maximum tensile strain t (%) and a maximum compressive strain c (%) in the rolling direction satisfying Expression (1):

$$t+0.06 \leq t+c \leq 0.35 \quad (1),$$

wherein a transformer iron loss $W_{17/50}$ is 0.90 W/kg or less and a noise level is lower than 45 dBA.

2. A method of manufacturing the grain-oriented electrical steel sheet of claim 1, comprising irradiating a steel sheet with a high energy beam in a direction that intersects a rolling direction of the steel sheet, wherein the steel sheet is irradiated with the high energy beam in a direction forming an angle of 30° or less with a direction orthogonal to the rolling direction, at periodic intervals of 10 mm or less in the rolling direction, and under a condition that a surface scanning rate v (m/s) on the steel sheet and a beam diameter d (μm) satisfy Expression (2):

$$200 \leq d \leq -0.04 \times v^2 + 6.4 \times v + 190 \quad (2).$$

* * * * *